United States Patent [19]

Stähli

[11] 4,357,720

[45] Nov. 9, 1982

[54] FLUSH VALVE MOUNTING FOR TOILETS

[75] Inventor: Paul Stähli, Jona, Switzerland

[73] Assignee: Geberit AG, Jona, Switzerland

[21] Appl. No.: 159,975

[22] Filed: Jun. 16, 1980

[30] Foreign Application Priority Data

Dec. 18, 1979 [CH] Switzerland ..... 11222/79

[51] Int. Cl.[3] ..... E03D 1/34

[52] U.S. Cl. ..... 4/378; 4/383; 4/387; 4/389; 4/391

[58] Field of Search ..... 4/324, 327, 355–356, 4/358, 378–379, 387–388, 395, 398, 389, 390–391

[56] References Cited

U.S. PATENT DOCUMENTS

| | | | |
|---|---|---|---|
| 2,010,119 | 8/1935 | Tilden | 4/391 |
| 2,077,832 | 4/1937 | Gabart | 4/391 |
| 2,131,765 | 10/1938 | Teahen | 4/391 |
| 2,996,727 | 8/1961 | Rose | 4/356 |
| 3,969,774 | 7/1976 | Karlsson | 4/391 X |
| 4,011,605 | 3/1977 | Karlsson | 4/391 X |
| 4,101,986 | 7/1978 | Ng et al. | 4/389 X |

*Primary Examiner*—Henry K. Artis

*Attorney, Agent, or Firm*—Pollock, Vande Sande & Priddy

[57] ABSTRACT

A flush valve mounting permitting adjustment of water flow to the requirements of different types of toilet bowl comprises a housing in which a float container with a float therein is removably emplaced. The lower portion of the housing has window apertures through which water can flow from the flush tank into a drain upon lifting of the pipe which carries the valve plate. A wall extending downwardly from the floor of the float container abuts the interior of the window openings, and this wall itself has through-flow apertures separated by webs formed by the wall. The openings in the window apertures are diminished by rotating the float container relative to the housing. This permits the water flow to be adjusted to the requirements of the particular toilet bowl.

4 Claims, 5 Drawing Figures

Fig. I
12
11
10
26
27
25
25a
21
22
1
II
II
24
23
28
III
III
28a
13
9
28b
2
16
8
5
6
4
3
7

FLUSH VALVE MOUNTING FOR TOILETS

SUMMARY OF THE INVENTION

The present invention relates to a flush valve mounting for toilets.

BACKGROUND OF THE INVENTION

Flush valve mountings of the type having through-flow openings in the lower portion of the valve housing are known, e.g., from Swiss Pat. No. 443,172, and are adapted for use with existing flush tanks and toilet bowls in which the liquid which, upon opening of the flush valve, flows into the drain pipe, has a constant rate of flow.

In order to adapt the same mounting for use with other types of toilet bowl, the invention provides the mounting with an adjustable flow of flush water. This permits adjustment of the amount of water entering the toilet bowl or similar unit per unit of time, so that, e.g., splashing is avoided.

BRIEF INTRODUCTION TO THE DRAWINGS

In order that the invention may be more clearly understood, reference will now be made to the accompanying drawings, wherein several embodiments are shown for purposes of illustration, and wherein.

DESCRIPTION OF PREFERRED EMBODIMENT

Figure 1:
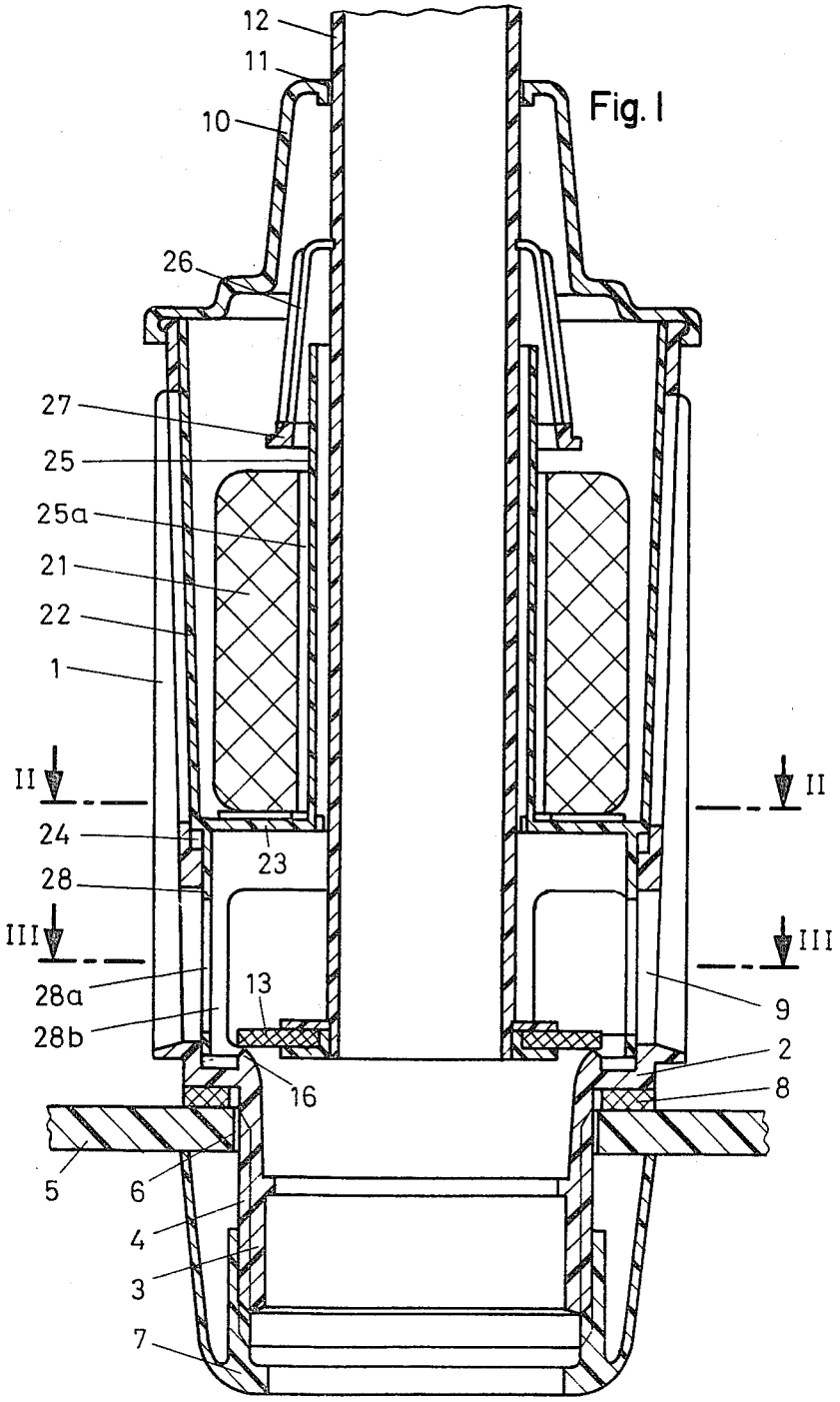
FIG. 1 is a longitudinal section through a first embodiment of a flush valve mounting according to the invention.

The flush valve mounting according to FIG. 1 comprises a basket-like housing 1 whose lower end has a flange 2 leading to a socket 3 provided with external threading 4. The floor 5 of a conventional toilet flush tank (not shown) has an aperture 6 into which socket 3 is placed. Housing 1 is attached to floor 5 by a nut 7 located on threading 4, a seal 8 being provided beneath flange 2. A drain conduit (not shown) leading to the toilet bowl is also attached to socket 3.

Immediately above flange 2, housing 1 is provided with four large windows 9, through which the water located in the flush tank can pass. At the top, the housing is provided with hooded cover 10 having a central bore 11. A pipe 12 passes through said bore in a manner known per se, and is provided at its lower end with a valve plate 13, e.g., of solid rubber, the plate being retained between two rings attached to pipe 12. Valve plate 13 cooperates with a valve seat formed by a small bead 16 provided at the inner edge of the upper surface of flange 2. At its top, pipe 12 is connected with a connecting pipe (not shown) conventionally connected to an actuating handle which serves for opening flush valve 13, 16 by upward pull on pipe 12.

A float container 22 containing a float 21 is removably inserted in housing 1. The container has a floor 23 resting on a shoulder 24 of housing 1 and an outer liner extending along the ribs of housing 1 to hooded cover 10, whereby float container 22 is retained on shoulder 24. Float container 22 also has an inner liner 25 which is only slightly shorter than outer liner 22. Considerable play **25*a* exists between pipe 12 and inner liner 24. Attached to pipe 12 is a ring 26 from which several arms extend downwardly, a support ring 27** being attached to the lower ends of these arms.

The drawing shows the above-described mounting in the position which it assumes when the flush tank is empty. When water runs into the latter, it fills both housing 1 and float container 22, by passing through windows 9, the area of play **25*a* between pipe 12 and inner liner 25, and the area of play of pipe 12 in bore 11. This lifts float 21 to a position in which it is supported by ring 27. However, float 21 cannot lift pipe 12 since the latter is retained in its illustrated position by the pressure of the water on valve plate 13, i.e., valve 13, 16 remains closed. If, however, pipe 12 is lifted by means of the actuating handle, the water flows through windows 9 into socket 3. Float 21 maintains pipe 12 with valve plate 13** in open position until all the water runs out of the float container through apertures (not shown).

Figure 3:
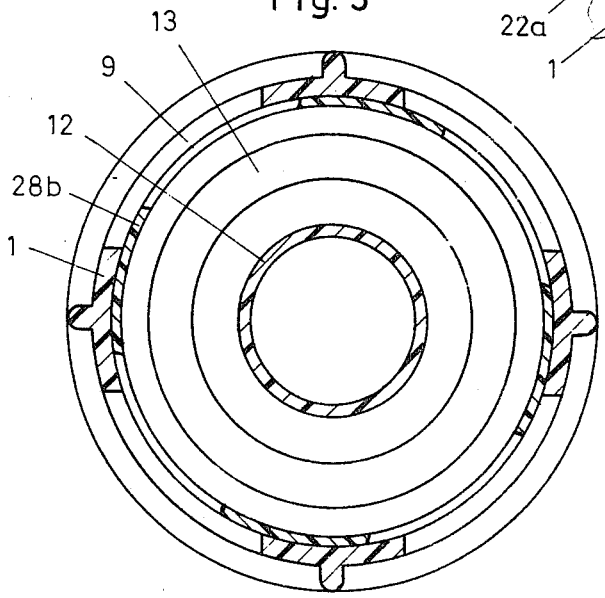
FIG. 3 is a section view along line III—III of FIG. 1.

The above-described configuration of the flush valve mounting is known in the art. Upon lifting of pipe 12, a specific quantity of water per second flows through windows 9 into drain socket 3. This quantity of water is adapted to conventional toilet bowls. However, in order to permit adaptation of the mounting to the available water supply of various types of toilet bowl, the present invention provides means for adjusting the flush flow by diminution of the clear opening of windows 9 in housing 1. In the embodiment shown in FIG. 1, this object is achieved by providing float container 22, which is removably inserted in housing 1, underneath its floor 23 with a downwardly extending annular wall 28, which abuts the inner wall of housing 1 with windows 9. Wall 28 has four through openings **28*a*, generally corresponding to windows 9, between which openings wall portions are provided as webs 28*b* (see also FIG. 3). Shoulder 24, on which float container 22 rests in housing 1, is provided with a sawtooth serration 1*a* which meshes with a corresponding serration 22*a* of float container 22**.

Figure 2:
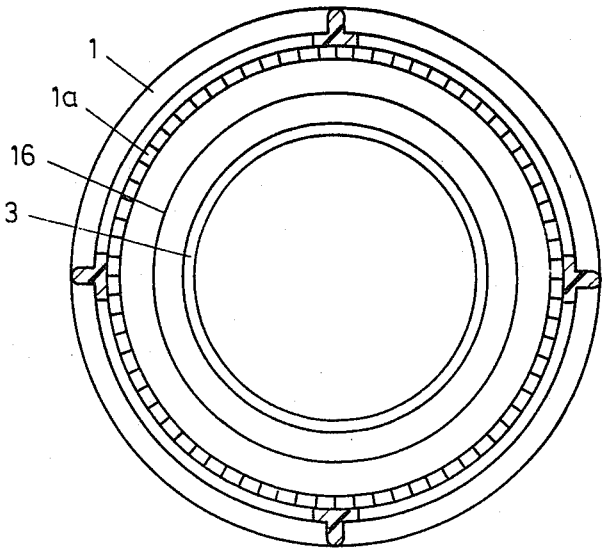
FIG. 2 is a section view through the mounting housing along line II—II of FIG. 1, omitting the interior elements.
Figure 4:
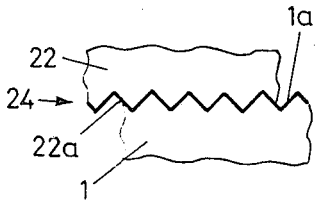
FIG. 4 is a detail view of the gearing between the float container and the housing.

In order to set the desired flush flow, hooded cover 10 is removed after the mounting is installed. Float container 22 can then be raised somewhat so as to uncouple gearing **1*a*, 22*a*. Float container 22 can now be rotated relative to housing 1 until windows 9 are covered in the desired manner by webs 28*b* of wall 28, thereby diminishing the passage cross section. The float container is then again lowered in housing 1 and the hooded cover is replaced. Coupling 1*a*, 22*a* prevents undesired rotation of the float container. FIG. 2 shows a section through housing 1 without the float container and pipe 12**.

Figure 5:
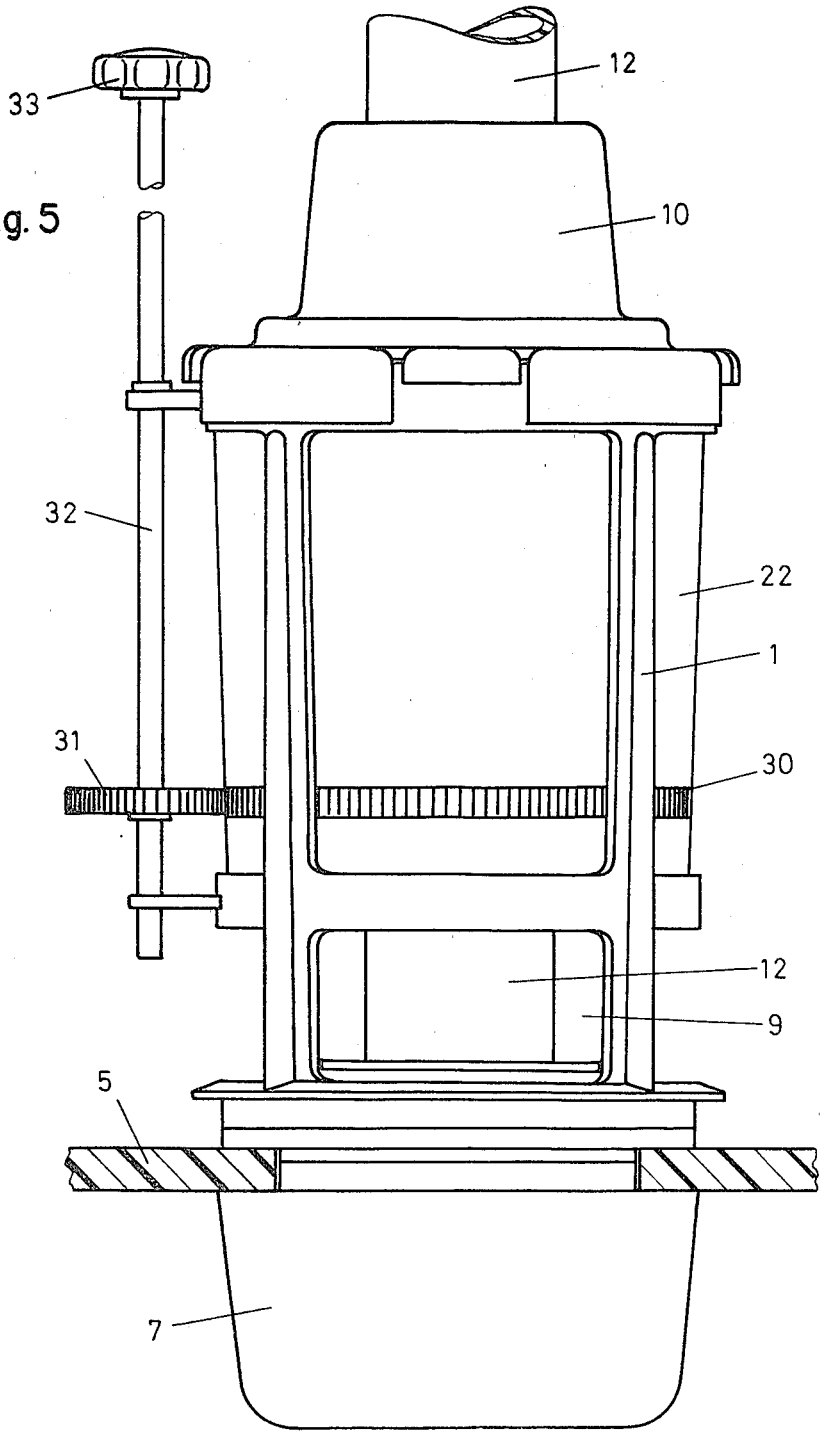
FIG. 5 shows a front elevation of a second embodiment of a mounting according to the invention.

FIG. 5 is a front elevation of a second embodiment of a flush valve mounting according to the present invention. This structure corresponds generally to that of the first embodiment. However, shoulder 24 on which float container 22 rests in housing 1 has no serration, i.e., no security against rotation. Instead, a gear rim 30 is arranged on its exterior surface, and this gear rim is engaged by a pinion 31 mounted on an axle 32 and actuatable by means of a turn button 33. This embodiment permits setting of the passage cross section without raising hooded cover 10, and is particularly appropriate for concealed flush tanks.

Adjustment of the passsage cross section of windows 9 could also be achieved by providing the exterior of housing 1 with a height adjustable ring which alters the height of the unobstructed area of windows 9 according to its position.

In the embodiments according to FIGS. 1 and 5, including the rotatable float container 22, a graduated scale visible from above can be attached to the upper end of the float container, so that the setting of the passage cross sections can be noted.

What is claimed is:

1. Flush valve mounting for a flush tank, comprising (a) a housing having in its lower portion at least one window with a through-flow opening;

(b) a float container contained in said housing and having a floor;

(c) a float in said float container cooperating with an abutment attached to a pipe having said housing, said float container and said float coaxially mounted thereon;

(d) a valve plate for a flush valve mounted on the lower end of said pipe, and causing said valve to open when said pipe is lifted, said valve remaining in open position until said float container is substantially empty of water;

(e) adjustable means being provided for diminishing the size of said through-flow opening of said at least one window, said adjustable means comprising a downwardly extending annular wall beneath said floor of said float container, said wall having flow-through openings separated be webs, said float container being rotatable relative to said housing, whereby said webs are caused to cover at least a portion of said windows.

2. Flush valve mounting according to claim 1, wherein said floor of said float container rests on a shoulder of said housing, said shoulder and said float container having respective coupling means whose mutual engagement prevents rotation of said float container relative to said housing.

3. Flush valve mounting according to claim 2, wherein the exterior side of said float container is provided with a gear rim engaged by a pinion mounted on an axle rotatably supported on said housing and actuatable by means of a turn button.

4. Flush valve mounting for a flush tank, comprising (a) a housing having in its lower portion at least one window with a through-flow opening;

(b) a float container contained in said housing and having a floor;

(c) a float in said float container cooperating with an abutment attached to a pipe having said housing, said float container and said float coaxially mounted thereon;

(d) a valve plate for a flush valve mounted on the lower end of said pipe, and causing said valve to open when said pipe is lifted, said valve remaining in open position until said float container is substantially empty of water;

(e) adjustable means being provided for diminishing the size of said through-flow opening of said at least one window, said adjustable means comprising an annular member arranged on the exterior side of said housing in the area of said windows, said annular member being height adjustable along said housing, whereby its vertical position determines the extent to which said windows remain unobstructed.

* * * * *